US009074515B2

(12) United States Patent
Komatsu et al.

(10) Patent No.: US 9,074,515 B2
(45) Date of Patent: Jul. 7, 2015

(54) VEHICLE HEAT-EXCHANGE MODULE

(75) Inventors: Yoshinao Komatsu, Tokyo (JP); Atsushi Suzuki, Tokyo (JP); Tsuyoshi Eguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 576 days.

(21) Appl. No.: 13/386,770

(22) PCT Filed: Dec. 1, 2010

(86) PCT No.: PCT/JP2010/071482

§ 371 (c)(1),
(2), (4) Date: Jan. 24, 2012

(87) PCT Pub. No.: WO2011/074417

PCT Pub. Date: Jun. 23, 2011

(65) Prior Publication Data

US 2012/0118539 A1 May 17, 2012

(30) Foreign Application Priority Data

Dec. 15, 2009 (JP) ..... 2009-284256

(51) Int. Cl.
*F01D 5/08* (2006.01)
*F01P 5/06* (2006.01)
(Continued)

(52) U.S. Cl.
CPC . *F01P 5/06* (2013.01); *F01P 11/12* (2013.01); *F04D 29/542* (2013.01); *F04D 29/663* (2013.01); *F28F 9/002* (2013.01); *F28D 1/0435* (2013.01)

(58) Field of Classification Search
CPC ... F04D 19/002; F04D 29/325; F04D 29/541; F04D 29/542; F04D 29/663; F01P 5/06; F01P 11/12; F28D 1/0435; F28F 9/002
USPC ..... 415/178, 211.2; 416/169 A
See application file for complete search history.

(56) References Cited

U.S. PATENT DOCUMENTS 5,342,167 A * 8/1994 Rosseau ..... 415/119
6,305,333 B1 10/2001 Maruta et al.
(Continued)

FOREIGN PATENT DOCUMENTS

CN 1549900 A 11/2004
EP 0367079 A1 5/1990
(Continued)

OTHER PUBLICATIONS

Maliczak, Development of an anlytical tool to predict the noise emitted by a diesel cooling fan unit, Feb. 1, 2005.*
(Continued)

*Primary Examiner* — Dwayne J White
*Assistant Examiner* — Jason Fountain
(74) *Attorney, Agent, or Firm* — Westerman, Hattori, Daniels & Adrian, LLP

(57) ABSTRACT

An object is to provide a vehicle heat-exchange module that is capable of reducing abnormal sound generated by interference between rotor blades of a propeller fan and high-static-pressure regions generated at leading edges of stator blades, while decreasing the input power of a fan motor by providing the stator blades on the downstream side of the propeller fan. In a vehicle heat-exchange module including a fan motor that drives a propeller fan, the fan motor is supported to the fan shroud at a downstream side of the propeller fan via motor support struts formed into stator blades in a radiating pattern, and a distance between stator blades formed of the motor support struts and rotor blades of the propeller fan for a narrowest portion at the same position in the radial direction is at least 0.018D<L1, where D is the diameter of the rotor blades.

1 Claim, 2 Drawing Sheets

(51) Int. Cl.

| | |
|---|---|
| ***F01P 11/12*** | (2006.01) |
| ***F04D 29/54*** | (2006.01) |
| ***F04D 29/66*** | (2006.01) |
| *F28F 9/00* | (2006.01) |
| *F28D 1/04* | (2006.01) |

(56) References Cited

U.S. PATENT DOCUMENTS

| | | | | |
|---|---|---|---|---|
| 6,398,492 | B1 | 6/2002 | Cho et al. | |
| 7,654,793 | B2 * | 2/2010 | Savage | 415/208.2 |
| 2003/0026699 | A1 | 2/2003 | Stairs et al. | |
| 2011/0114286 | A1 * | 5/2011 | Komatsu et al. | 165/51 |

FOREIGN PATENT DOCUMENTS

| | | | |
|---|---|---|---|
| EP | 1016790 | A2 | 7/2000 |
| EP | 1016790 | B1 * | 8/2004 |
| JP | 2-123221 | A | 5/1990 |
| JP | 04-086322 | A | 3/1992 |
| JP | 11-311127 | A | 11/1999 |
| JP | 3385336 | B2 | 3/2003 |
| JP | 4029035 | B2 | 1/2008 |

OTHER PUBLICATIONS

Bleier, F. P., "Fan Handbook-selection, application, and design", Jan. 1, 1998, p. 4.26-4.27.*

Extended European Search Report dated Feb. 25, 2014, issued in European Patent Application No. 10837446.3-1606 (7 pages).

Maliczak, C., "Development of an analytical tool to predict the noise emitted by a diesel cooling fan unit", May 29, 2008, XP055096113, Silence, pp. 1-41; Cited in Extended European Search Report dated Feb. 25, 2014 (21 pages).

International Search Report of PCT/JP2010/071482, mailing date Jan. 18, 2011.

Chinese Office Action dated May 6, 2014, issued in corresponding CN application No. 201080033016.2 with English translation (12 pages).

Maliczak et al., Development of an anlytical tool to predict the noise emitted by a diesel cooling fan unit, Feb. 1, 2005, cited in US Office Action dated Jun. 26, 2014, issued in corresponding U.S. Appl. No. 13/386,770, (21 pages).

* cited by examiner

VEHICLE HEAT-EXCHANGE MODULE

TECHNICAL FIELD

The present invention relates to a vehicle heat-exchange module in which an engine-cooling radiator and/or an air-conditioner condenser and a fan unit to be installed in a vehicle are integrated into a module.

BACKGROUND ART

There is a known vehicle heat-exchange module in which an air-conditioner condenser and/or an engine-cooling radiator, a propeller fan, a fan motor, etc. are sequentially disposed from the front side at a front portion of an engine compartment, thereby being integrated into a module (also referred to as "CRFM"). This CRFM is provided with a fan shroud, in which a channel sectional area thereof sharply decreases toward the propeller fan, which directly faces the condenser and/or the radiator at a downstream side thereof, so as to guide external air taken in through the condenser and/or the radiator to the propeller fan.

In such a vehicle heat-exchange module, the fan motor is usually supported by the fan shroud via numerous motor support struts (motor support stators) in a radiating pattern at a downstream side of the propeller fan (for example, see Patent Literature 1). In addition, for example, Patent Literature 2 discloses a vehicle heat-exchange module in which, in order to reduce the input power of the fan motor, the motor support struts disposed in a radiating pattern on the downstream side of the propeller fan are formed into stator blades.

CITATION LIST

Patent Literature

{PTL 1} Publication of Japanese Patent No. 4029035 (see FIG. 1 and FIG. 6).

{PTL 2} Publication of Japanese Patent No. 3385336 (see FIGS. 1 to 5).

SUMMARY OF INVENTION

Technical Problem

As described above, by forming the motor support struts disposed in a radiating pattern on the downstream side of the propeller fan into the stator blades, the input power of the fan motor can be reduced, and the efficiency thereof can be increased. However, when the stator blades are installed on the downstream side of the propeller fan, high-static-pressure regions due to stagnation pressure occur at leading edges of the stator blades when the fan is rotated. Because the stator blades are disposed in a radiating pattern and multiple blades are disposed in the circumferential direction, high-static-pressure regions periodically occur in the circumferential direction in accordance with the number of stator blades. Accordingly, there is a problem in that, when the fan is rotated, rotor blades of the propeller fan periodically interfere with the high-static-pressure regions, and abnormal sound (Nz sound), which is dependent on the fan rotation speed and the number of rotor blades, is generated.

On the other hand, if the distance between the rotor blades and the stator blades is increased in order to alleviate the interference between the rotor blades of the propeller fan and the high-static-pressure regions (stator blades), there is a problem in that the depth-wise size of the heat-exchange module (CRFM) is increased, making it necessary to increase the space for installing it in a vehicle, and thus, the ease of installation is deteriorated.

The present invention has been conceived in light of these circumstances, and an object thereof is to provide a vehicle heat-exchange module that is capable of reducing abnormal sound generated due to interferences between rotor blades of a propeller fan and high-static-pressure regions that occur at leading edges of stator blades, while reducing the input power of a fan motor by providing stator blades on downstream side of the propeller fan.

Solution to Problem

In order to solve the above-described problems, a vehicle heat-exchange module of the present invention employs the following solutions.

Specifically, a vehicle heat-exchange module according an aspect of the present invention is a vehicle heat-exchange module including a rectangular heat exchanger; and a fan unit provided on a downstream side of the heat exchanger, the fan unit being provided with a fan shroud having a ring-shaped opening, a propeller fan disposed in the ring-shaped opening of the fan shroud, and a fan motor that drives the propeller fan, wherein the fan motor is supported on the fan shroud at the downstream side of the propeller fan via motor support struts formed into stator blades in a radiating pattern; and a distance L1 between the rotor blades of the propeller fan and the stator blades formed of the motor support struts for the narrowest portion at the same position in the radial direction is at least $0.018D<L1$, where D is the diameter of the rotor blades.

With the above-described aspect, the fan motor is supported on the fan shroud at the downstream side of the propeller fan via the motor support struts formed into stator blades in a radiating pattern, and the distance L1 between the rotor blades of the propeller fan and the stator blades formed of the motor support struts for the narrowest portion at the same position in the radial direction is set to be at least $0.018D<L1$, where D is the diameter of the rotor blades; therefore, by appropriately setting the distance L1 between the stator blades and the rotor blades of the propeller fan to be at least $0.018D<L1$, it is possible to reduce the abnormal sound (Nz sound), which is dependent on the fan rotational speed and the number of rotor blades, generated when high-satic-pressure regions occur at leading edges of the stator blades due to stagnation pressure and when the high-static-pressure regions interfere with the rotor blades, while reducing the input power of the fan motor by providing the stator blades on the downstream side of the propeller fan. Accordingly, it is possible to achieve both increased efficiency through a reduction in the input power of the fan motor and reduced fan noise. Note that, it was experimentally confirmed that the noise level of the Nz sound can be suppressed to 20 dB or less by setting the above-described distance L1 to be at least $0.018D<L1$.

In addition, with the above-described vehicle heat-exchange module, the distance L1 may be set within a range $0.018D<L1<0.033D$.

With the above-described aspect, because the distance L1 between the stator blades and the rotor blades is set within the range $0.018D<L1<0.033D$, it is possible to achieve a reduction in the input power of the fan motor and reduced fan noise with out increasing the distance L1 between the stator blades and the rotor blades, that is, the depth-wise size of the heat-exchange module itself, while keeping it within an appropriate range. Therefore, the ease of installation and the ease of arrangement preferable for vehicles can be maintained.

Because the static pressure recovery level (Pa) at the stator blades can be maximized by setting the above-described distance L1 within the range 0.018D<L1<0.033D, the pressure loss in a flow caused by the stator blades can be minimized, and the fan performance can be improved.

Furthermore, in any of the vehicle heat-exchange modules described above, the number of rotor blades in the propeller fan may be at least 9 or more, the number of stator blades formed of the motor support struts may be at least 13 or more, and the numbers may be coprime.

With the above-described aspect, the number of rotor blades of the propeller fan is set to be at least 9 or more, the number of stator blades formed of the motor support struts is set to be at least 13 or more, and they are set to be coprime numbers; therefore, by setting the number of rotor blades of the propeller fan and the number of stator blades formed of the motor support struts to be 9 or more and 13 or more, respectively, thereby forming them in multi-blade forms, the depth-wise size (axial-direction size) of the fan unit and, consequently, that of the heat-exchange module, can be made sufficiently small. Accordingly, sufficient distance L1 between the rotor blades and the stator blades can be ensured without increasing the depth-wise size of the heat-exchange module, and noise reduction can be achieved while maintaining the ease of installation and the ease of arrangement in vehicles. Because the number of rotor blades and the number of stator blades are set to be coprime numbers, pressure fluctuations generated around the rotor blades can be prevented from occurring in the same phase, an increase in discrete-frequency noise due to pressure interference in a specific frequency region can be prevented, and the fan noise can be reliably suppressed.

Advantageous Effects of Invention

With the present invention, it is possible to reduce abnormal sound (Nz sound), which is dependent on the fan rotational speed and the number of the rotor blades, generated when high-satic-pressure regions occur at leading edges of the stator blades due to stagnation pressure and when the high-static-pressure regions interfere with the rotor blades, while reducing the input power of the fan motor by providing the stator blades on the down stream side of the propeller fan; therefore, by appropriately setting the distance L1 between the stator blades and the rotor blades of the propeller fan to be at least 0.018D<L1, it is possible to achieve both increased efficiency through an reduction in the input power of the fan motor and reduced fan noise. It was experimentally confirmed that the noise level of the Nz sound can be suppressed to 20 dB or less by setting the above-described distance L1 to be at least 0.018D<L1.

DESCRIPTION OF EMBODIMENTS

An embodiment of the present invention will be described below with reference to FIGS. 1 to 3.

Figure 1:
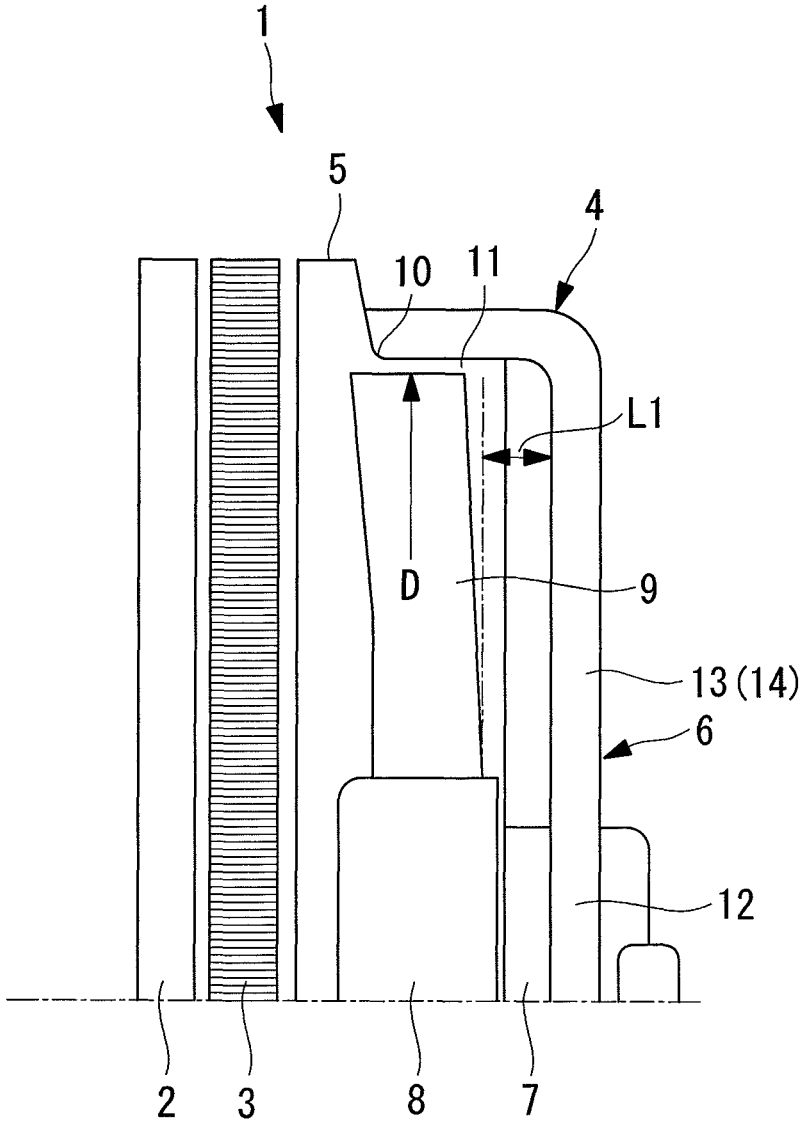
FIG. 1 is a longitudinal sectional view of the top half of a vehicle heat-exchange module according to an embodiment of the present invention.

FIG. 1 shows a longitudinal sectional view of the top half of a vehicle heat-exchange module according to the embodiment of the present invention.

In a vehicle heat-exchange module 1, an air-conditioner condenser 2, a radiator 3 that cools engine coolant, and a fan unit 4, which are sequentially disposed along an airflow direction, are integrated into a module via brackets, etc. In the following, the heat-exchange module 1 may be simply referred as CRFM (Condenser Radiator Fan Module).

The CRFM 1 is often disposed at a front side in a vehicle engine compartment facing a front grille, and for ease of installation to a vehicle or ease of arrangement in the engine compartment, etc., it is desirable to make the depth-wise size as small as possible and to make the module lightweight. Accordingly, the module often takes a rectangular shape that is longer laterally as a whole, and thin heat exchangers having a laterally elongated rectangular shape with a relatively large front area are employed as the condenser 2 and the radiator 3. In the following, the condenser 2 and the radiator 3 may collectively be simply referred to as heat exchangers.

The fan unit 4 is integrally mounted on the downstream side of the condenser 2 and the radiator 3. This fan unit 4 is provided with a fan shroud 5 for guiding cooling air (external air) that has passed through the condenser 2 and the radiator 3 to a propeller fan 8, motor support struts 6 that are integrally molded with the fan shroud 5, a fan motor 7 that is securedly supported by the motor support struts 6, and the propeller fan 8 that is attached to a rotating shaft (not shown) of the fan motor 7 to be rotationally driven. The propeller fan 8 is a multi-blade propeller fan 8 in which the number (number of blades) of rotor blades 9 is at least nine or more.

The fan shroud 5 is an integrally molded part in which a plastic material is employed, wherein an outer circumferential edge at a front opening thereof has substantially the same shape as the external shape of the radiator 3; a bell mouth 10 and a ring-shaped opening 11 are provided at substantially a center portion; and a channel sectional area is sharply reduced from the front opening toward the bell mouth 10 and the ring-shaped opening 11. The motor support struts 6 for securedly supporting the fan motor 7 are integrally molded with the fan shroud 5.

The motor support struts 6 are formed of motor securing portions 12 that securedly support the fan motor 7 and numerous support stays 13 that extend from the motor securing portions 12 in a radiating pattern to an outer circumference of the ring-shaped opening 11 in the fan shroud 5, and the numerous support stays 13 are formed into stator blades to reduce the input power to the fan motor 7. The stator blades 14 formed of the support stays 13 are formed in a blade shape having a predetermined width that are inclined with respect to the rotation direction of the propeller fan 8. At least 13 or more stator blades 14 formed of the support stays 13 of the motor support struts 6 are disposed in the circumferential direction in a radiating pattern.

With regard to the rotor blades 9 of the propeller fan 8 and the stator blades 14 formed of the support stays 13 of the motor support struts 6, in order to reduce abnormal sound (Nz sound) caused by interferences between the rotor blades 9 and the stator blades 14 resulting from installing the stator blades 14 on the downstream side of the rotor blades 9 and to suppress an increase in the depth-wise size of the CRFM 1, the distance L1 is set to be at least 0.018D<L1 and is set within the range 0.018D<L1<0.033D, where L1 is a distance between the rotor blades 9 and the stator blades 14 for a narrowest portion at the same position in the radial direction and D is the diameter of the rotor blades 9. For the stator blades 14 and the rotor blades 9 of the propeller fan 8, the number of stator blades is at least 13 or more, and the number of rotor blades is at least 9 or more; they are set to be coprime numbers.

With the above-described configuration, this embodiment affords the following effects and advantages.

In the above-described CRFM 1, when the propeller fan 8 is rotated by being driven by the fan motor 7, the external air is taken in through the condenser 2 and radiator 3 from a front face of the condenser 2. After circulating through the condenser 2 and the radiator 3, the external air is guided to the propeller fan 8 that is rotating in the ring-shaped opening 11 connected to the bell mouth 10 in the fan shroud 5 and is blown out to the downstream side of the ring-shaped opening 11 via the rotor blades 9. By doing so, refrigerant and engine coolant are cooled in the condenser 2 and the radiator 3 through heat exchange with the external air.

The air blown out from the propeller fan 8 has a swirling-direction component which is redirected to the axial direction via the stator blades 14 provided on the downstream side thereof, and the flow energy of the swirling-direction component is recovered, thereby increasing the air blowing efficiency of the propeller fan 8. In other words, the stator blades 14 convert velocity energy of the air being blown from the rotor blades 9 of the propeller fan 8 to pressure energy and thus increase static pressure, thereby serving to increase the air blowing efficiency in the axial direction. Accordingly, the input power of the fan motor 7 can be reduced.

On the other hand, with the stator blades 14 provided on the downstream side of the rotor blades 9, high-static-pressure regions due to stagnation pressure occur at the leading edges of the stator blades 14 when the fan is rotated, as described above. Because the stator blades 14 are disposed in a radiating pattern and multiple blades are disposed in the circumferential direction, the high-static pressure regions periodically occur in the circumferential direction in accordance with the number of stator blades, and thus, the high-static-pressure regions and the rotor blades 9 periodically interfere with each other, generating abnormal sound (Nz sound), which is dependent on the fan rotational speed and the number of rotor blades.

Figure 2:
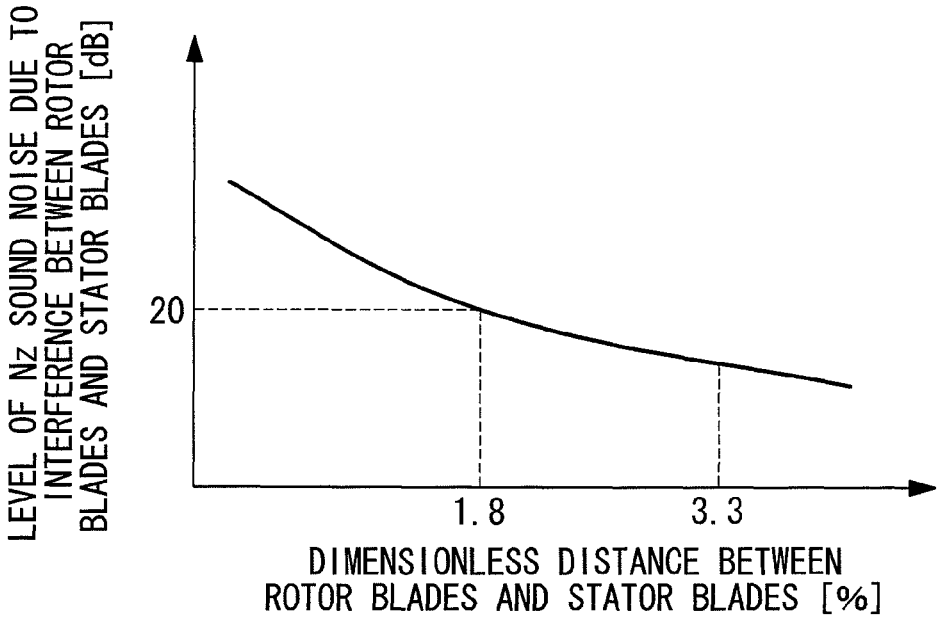
FIG. 2 is a diagram showing, for the vehicle heat-exchange module shown in FIG. 1, the relationship between dimensionless distance (%) between rotor blades and stator blades and noise level (dB) of Nz sound caused by interference between the rotor blades and stator blades.

Therefore, in this embodiment, an appropriate distance is ensured between the rotor blades 9 and the stator blades 14 such that the distance L1 is at least 0.018D<L1, where L1 is the distance between the rotor blades 9 and the stator blades 14 for a narrowest portion at the same position in the radial direction, and D is diameter of the stator blades 9; therefore, as shown in FIG. 2, the noise level of the above-described abnormal sound (Nz sound) that is dependent on the fan rotational speed and the number of rotor blades can be suppressed to 20 dB or less. Therefore, it is possible to achieve both increased efficiency through a reduction in the input power of the fan motor 7 and reduced fan noise.

Because the distance L1 between the stator blades 14 and the rotor blades 9 is set within the range 0.018D<L1<0.033D, it is possible to achieve a reduction in the input power of the fan motor 7 and reduced fan noise without increasing the distance L1 between the stator blades 14 and the rotor blades 9, that is, the depth-wise size of the heat-exchange module 1 itself, while keeping the size within an appropriate range. Therefore, the ease of installation and the ease of arrangement that are prefer able for a vehicle can be maintained.

Figure 3:
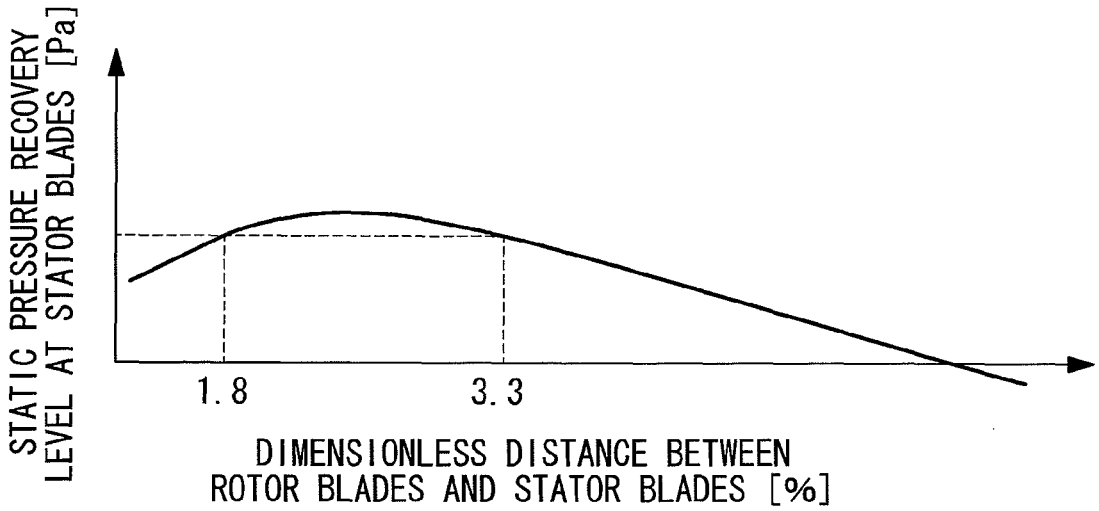
FIG. 3 is a diagram showing, for the vehicle heat-exchange module shown in FIG. 1, the relationship between dimensionless distance (%) between the rotor blades and the stator blades and the static pressure recovery level (Pa) at the stator blades.

As shown in FIG. 3, by setting the distance L1 between the stator blades 14 and the rotor blades 9 within the range 0.018D<L1<0.033, the static pressure recovery level (Pa) at the stator blades 14 can be maximized; therefore, pressure loss of a flow caused by the stator blades 14 can be minimized, and the fan performance can be improved. Specifically, the static pressure recovery level (Pa) at the stator blades 14 follows a curve that protrudes upward in accordance with the distance L1 between the stator blades 14 and the rotor blades 9, as shown in FIG. 3. The reason for this is as follows.

The stator blades 14 raise (recover) the static pressure by recovering the swirling component (swirling dynamic pressure) of the outgoing flow from the rotor blades 9. Because the swirling component of the flow gets smaller further towards the downstream side of the rotor blades 9, the dynamic pressure level that can be recovered monotonically decreases toward the downstream side of the rotor blades 9. On the other hand, the pressure loss caused by the stator blades 14 decreases to a certain point on the downstream side of the rotor blades 9 and subsequently increases. Because the static pressure recovery level is defined as [dynamic pressure recovery level]−[stator-blade pressure loss], it shows a trend with a peak at a certain distance downstream from the rotor blades 9, as shown in FIG. 3.

With regard to the pressure loss caused by the stator blades 14, the pressure loss increases because the flow immediately after the outlet of the rotor blades 9 includes portions where the flow speed is locally increased. Because the localized high flow speed becomes alleviated further towards the downstream side, the influence of the high flow speed is largest near the outlet of the rotor blades 9. Furthermore, because the swirling component decreases further on the downstream side, the flow angle also changes. Because this flow angle change is not uniform over the sectional area, a difference in the flow angle increases in the circumferential direction. Accordingly, it becomes impossible to appropriately set the angle of the stator blades 14 with respect to the flow, and thus, the pressure loss caused by the stator blades 14 increases toward the downstream side of the rotor blades 9.

In this way, because the influences of the localized high flow speed immediately after the outlet of the rotor blades 9 and the circumferential-direction flow angle of the swirling component are superimposed, the pressure loss in the flow shows a trend in which the minimum value thereof appears at a certain distance on the downstream side of the rotor blades 9. Therefore, by setting the distance L1 between the stator blades 14 and the rotor blades 9 within the range 0.018D<L1<0.033D, the static pressure recovery level (Pa) at the stator blades 14 can be maximized, as shown in FIG. 3, and the fan performance can be improved through minimizing the pressure loss in the flow caused by the stator blades 14.

In this embodiment, the number of rotor blades 9 is set to be at least 9 or more and the number of stator blades 14, which are formed of the support stays 13 of the motor support struts 6, is set to be at least 13 or more, and they are set to be coprime numbers. Therefore, by setting the number of rotor blades 9 and the number of stator blades 14 to be 9 or more and 13 or more, respectively, and by forming the propeller fan 8 and the stator blades 14 in a multi-blade form, the depth-wise size (axial-direction size) of the fan unit 4, and, consequently, that of the heat-exchange module (CRFM) 1, can be made sufficiently small.

Therefore, it is possible to ensure a sufficient distance L1 between the rotor blades 9 and the stator blades 14 without increasing the depth-wise size of the CRFM 1 and to reduce the abnormal sound (Nz sound) while maintaining the ease of installation and the ease of arrangement in vehicles, thus achieving noise reduction in the fan unit 4. Because the number of rotor blades 9 and the number of stator blades 14 are set to be coprime numbers, pressure fluctuations that occur around the rotor blades 9 can be prevented from occurring in the same phase, an increase in discrete-frequency noise due to pressure interference in a specific frequency region can be prevented, and the fan noise can be reliably suppressed.

The present invention is not limited to the invention according to the above-described embodiment, and appropriate modifications are possible within a range that does not deviate from the spirit thereof. For example, although shapes of the stator blades 14 are not particularly limited in the above-described embodiment, the stator blades 14 may be stator blades of any shapes, such as plate shapes, arch shapes, airfoil shapes, etc. The stator blades 14 may be connected with each other with a ring at an appropriate position in the radial direction so as to ensure the strength thereof.

REFERENCE SIGNS LIST

1 vehicle heat-exchange module (CRFM)
2 condenser (heat exchanger)
3 radiator (heat exchanger)
4 fan unit
5 fan shroud
6 motor support strut
7 fan motor
8 propeller fan
9 rotor blade (blade)
11 ring-shaped opening
13 support stay
14 stator blade

The invention claimed is:

1. A vehicle heat-exchange module comprising:

a rectangular heat exchanger; and a fan unit provided on a downstream side of the heat exchanger, the fan unit being provided with a fan shroud having a ring-shaped opening, a propeller fan disposed in the ring-shaped opening of the fan shroud, and a fan motor that drives the propeller fan, wherein the fan motor is supported on the fan shroud at the downstream side of the propeller fan via motor support struts formed into stator blades in a radiating pattern; and a distance L1 between rotor blades of the propeller fan and the stator blades formed of the motor support struts for the narrowest portion at a same position in the radial direction is set within a range $0.018D<L1<0.033D$, where D is a diameter of the rotor blades and is set within a range in which a static pressure recovery level includes a peak value thereof, the static pressure recovery level being defined by subtracting stator-blade pressure loss from a dynamic pressure recovery level.

* * * * *